US011186988B2

(12) United States Patent
Mosiadz

(10) Patent No.: US 11,186,988 B2
(45) Date of Patent: Nov. 30, 2021

(54) ACOUSTIC PANEL

(71) Applicant: ROCKWOOL International A/S, Hedehusene (DK)

(72) Inventor: Maciej Grzegorz Mosiadz, Zielona Gora (PL)

(73) Assignee: ROCKWOOL INTERNATIONAL A/S, Hedehusense (DK)

( * ) Notice: Subject to any disclaimer, the term of this patent is extended or adjusted under 35 U.S.C. 154(b) by 0 days.

(21) Appl. No.: 15/756,314

(22) PCT Filed: Sep. 9, 2016

(86) PCT No.: PCT/EP2016/071378
§ 371 (c)(1),
(2) Date: Mar. 1, 2018

(87) PCT Pub. No.: WO2017/042372
PCT Pub. Date: Mar. 16, 2017

(65) Prior Publication Data

US 2018/0251976 A1 Sep. 6, 2018

(30) Foreign Application Priority Data

Sep. 11, 2015 (EP) ..... 15020158

(51) Int. Cl.
*E04B 9/00* (2006.01)
*E04B 9/04* (2006.01)
*E04C 2/16* (2006.01)

(52) U.S. Cl.
CPC ..... *E04B 9/001* (2013.01); *E04B 9/045* (2013.01); *E04C 2/16* (2013.01)

(58) Field of Classification Search
CPC .. E04B 9/001; E04B 9/045; E04B 2001/8457; E04B 2001/848; E04B 9/0464; E04C 2/16
USPC ..... 52/144
See application file for complete search history.

(56) References Cited

U.S. PATENT DOCUMENTS 3,357,516 A * 12/1967 Cadotte ..... E04B 9/045 181/290
3,859,110 A * 1/1975 Foster ..... B05D 5/02 264/220
3,908,059 A * 9/1975 Prince ..... E04B 9/04 428/206

(Continued)

FOREIGN PATENT DOCUMENTS

DE 29817995 U1 * 1/1999 ..... E04B 1/84
JP 59091050 A * 5/1984

OTHER PUBLICATIONS

Machine translation of DE 29817995 U1.*

(Continued)

*Primary Examiner* — Christine T Cajilig
(74) *Attorney, Agent, or Firm* — Tarolli, Sundheim, Covell & Tummino LLP

(57) ABSTRACT

Acoustic panels, grids for acoustic panels, suspended ceiling systems and a method for producing an acoustic panel, especially a man-made vitreous fibre (MMVF) panel, having a first major face and an opposite second major face, with the first major face comprising a facing with a surface coating. To provide high light reflection the coating comprises microspheres.

13 Claims, 4 Drawing Sheets

(56) References Cited

U.S. PATENT DOCUMENTS 4,283,457 A * 8/1981 Kolsky ..... B32B 5/06 442/30
4,545,165 A * 10/1985 Carey ..... E04B 9/345 403/346
5,602,221 A * 2/1997 Bennett ..... C08F 220/18 526/307.7
5,620,795 A * 4/1997 Haak ..... C08F 220/18 428/344
5,683,798 A * 11/1997 Bennett ..... C08F 220/18 428/312.6
5,869,166 A * 2/1999 Caldwell ..... E04B 9/045 428/142
6,558,369 B2 * 5/2003 Rosenblum ..... A61F 5/453 604/353
8,337,976 B2 * 12/2012 Mayers ..... E04B 9/045 156/62.8
9,856,638 B2 * 1/2018 Emborg ..... E02B 11/005
2001/0047629 A1 * 12/2001 Andersen ..... E01F 8/007 52/144
2002/0007910 A1 * 1/2002 Bennett ..... C08F 283/10 156/327
2002/0170467 A1 * 11/2002 Naji ..... B28B 1/522 106/705
2004/0137181 A1 * 7/2004 Ruid ..... B32B 5/26 428/36.91
2007/0277948 A1 12/2007 Carbo et al.
2007/0289238 A1 * 12/2007 Payne ..... E04F 15/20 52/408
2009/0126886 A1 * 5/2009 Englert ..... D21H 13/40 162/151
2009/0173570 A1 * 7/2009 Levit ..... E04B 9/04 181/286
2010/0083838 A1 * 4/2010 Togashi ..... B01D 39/1623 96/10
2011/0076470 A1 * 3/2011 Zaveri ..... B32B 5/18 428/196
2011/0147119 A1 * 6/2011 Cao ..... E04B 1/86 181/292
2012/0076983 A1 * 3/2012 Yu ..... B32B 3/30 428/141
2012/0103723 A1 * 5/2012 Pieper ..... E04B 9/0464 181/294
2012/0329898 A1 * 12/2012 Weikel ..... C08F 220/18 522/33
2014/0250811 A1 9/2014 Krause
2014/0251856 A1 * 9/2014 Larsson ..... B32B 27/10 206/524.3
2014/0271440 A1 * 9/2014 Constantz ..... C01F 11/181 423/430

OTHER PUBLICATIONS

International Search Report and Written Opinion dated Nov. 16, 2016 for corresponding International Application No. PCT/EP2016/071378.

Jiqing, Wang (2001), "Architectural Hall Acoustic Quality Design", p. 90, and English translation thereof.

* cited by examiner

ACOUSTIC PANEL

RELATED APPLICATIONS

The present application is a U.S. National Stage application under 35 USC 371 of PCT Application Serial No. PCT/EP2016/071378, filed on 9 Sep. 2016; which claims priority from EP Patent Application No. 15020158.0, filed 11 Sep. 2015, the entirety of both of which are incorporated herein by reference.

The invention relates to acoustic panels, grids for acoustic panels, suspended ceiling systems and a method for producing an acoustic panel, especially a man-made vitreous fibre (MMVF) panel, having a first major face and an opposite second major face, with the first major face comprising a facing with a surface coating.

Acoustic correction is an important part of creating good indoor environments, and this is of increasing concern, e.g. in open plan offices, schools and hospitals. Noise is a disturbing factor, which may have a negative influence on health and productivity. Acoustic panels can be used to achieve high level of acoustical comfort.

However in some cases acoustic panels are left out of consideration because the present panels have a surface, which is less than optimum in terms of light reflection.

US2007/0277948 A1 discloses an acoustical tile that includes a core and a surface treatment.

US3908059 discloses a ceiling tile that has a decorative face produced by applying a binder and a vast plurality of minute expandable plastic particles to patterned areas of the tile face and then applying heat to expand the particles and/or dry the binder.

According to a first aspect of the present invention it is an object to provide an acoustic panel with a high light reflection and still having acoustic performance.

This object is achieved by the surface coating comprising microspheres.

The microspheres may be made of silica, ceramics or glass. Choice of material for the microspheres may be influenced by cost, demand for strength or processing equipment.

The diameter of the microspheres may be chosen to fit the purpose, depending on the demands on e.g. acoustics, ease of cleaning, cost, whiteness, processing equipment etc. As an example the average diameter may be in the interval 10-200 μm, for example 10-120 μm, such as 15-70 μm. Generally a lower average diameter may give a more smooth texture, whereas a higher average diameter may reduce gloss. Microspheres with a relatively high average diameter may be more fragile and put constraints on the process equipment.

The microspheres provide high light reflection. The effect is comparable with a "bath foam effect"; although the bubbles are colourless, the surface curvature assures a white appearance. In some embodiments the effect may be further enhanced by adding pigment to the microspheres. Alternatively or supplementary the microspheres may have a surface coating or surface treatment.

A further advantage is that the microspheres hide the structure of the surface. Often front facings are directional in that e.g. fibres of the facing are predominantly directed in one direction, and this can often be seen in prior art panels. This means that the installer installing the panels must be careful to align all panels making up e.g. a suspended ceiling in the same direction. This is time consuming, and hence adds to the cost of the final ceiling. If adjacent panels are not aligned to have the same direction, it may have a negative effect on the aesthetics of the room.

Furthermore the microspheres are found to make the surface coating of the surface more robust, thereby making the surface coating more easy to clean.

According to an embodiment, the facing is a non-woven or a felt having an air permeability of 400-900 $l/m^2/s$. Air permeability in this range is found to provide a good compromise between a closed surface with optimum visual quality in terms of smoothness, light reflection etc and an open surface to provide acoustic performance, in particular sound absorption. The facing may be based on glass fibres, which have a favourable reaction to fire, whereas in other cases the facing may be based on for example plastic fibres to provide a softer facing, or a combination of plastic fibres and glass fibres. The facing may include a pigment or dye to provide the colour wanted, e.g. to provide a white facing with an L-value of at least 95.

An aspect of the invention relates to a suspended ceiling grid comprising a surface coating on surfaces visible in the installed state of the suspended ceiling. The surface coating comprises microspheres, which have the effect that the light reflection of the grid surfaces is comparable with the light reflection of the panels. Further it is found that the microspheres make the coated surface more robust and thus easier to clean.

A further aspect of the invention relates to a suspended ceiling system comprising an acoustic panel as defined above and a grid as outlined above.

Another aspect of the invention relates to a method for producing an acoustic panel comprising the steps of providing an acoustic panel, especially a MMVF panel, attaching a front facing to a first major face of the panel, applying a surface coating on the front facing, the surface coating comprises microspheres, and that prior to applying the surface coating, the surface coating is conditioned to have a viscosity of 20-40 s DIN CUP4.

This specific viscosity range is found to provide a suitable compromise of ease of application of the surface coating, good coverage of the surface, while providing a coating, which will not be too detrimental on the acoustic properties of the panels, especially with regard to sound absorption. In some cases a more narrow range of 28-38 s DIN CUP4 may be appropriate.

The microspheres are typically balls of ceramics, glass or silica with vacuum or air filled, and hence the microspheres are relatively light (generally e.g. 0.2 $kg/dm^3$). Due to the light weight of such microspheres, there is a tendency that the microspheres will migrate to the top of a tank containing the coating. Hence the surface coating is conditioned e.g. by mixing or stirring to have a homogeneous viscosity in tank, e.g. with a maximum variation in viscosity of 10% in the coating.

According to an embodiment the surface coating is applied using a low viscosity coating technique, such as using rollers, brushes, spray nozzles or curtain coating.

The invention will be described in the following by way of example with reference to the drawings in which.

Figure 1:
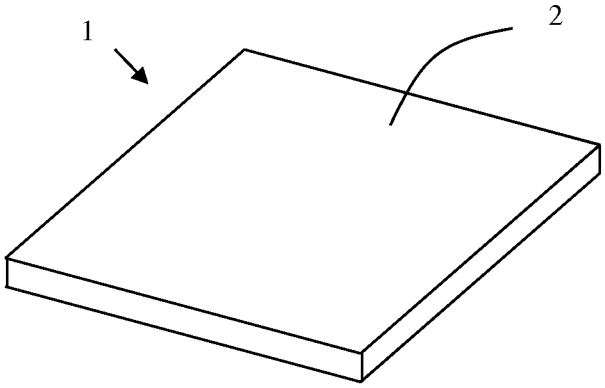
FIG. 1 is a sketch of a panel.

In the sketch of FIG. 1 is seen a panel (1) having a first major face (2) and an opposite second major face. The first major face (2) is provided with a facing, such as a non-woven or felt.

Figure 2:
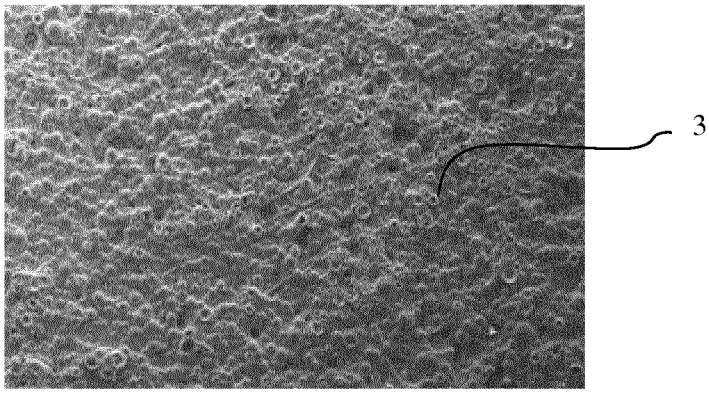
FIG. 2 is a close-up photo of a coated surface.

Microspheres (3) of the coating can be seen in the close-up photo of FIG. 2. As can be seen a number of the microspheres are situated in the surface providing the optical effect and giving a high light reflection and robustness of the surface coating.

Figure 3:
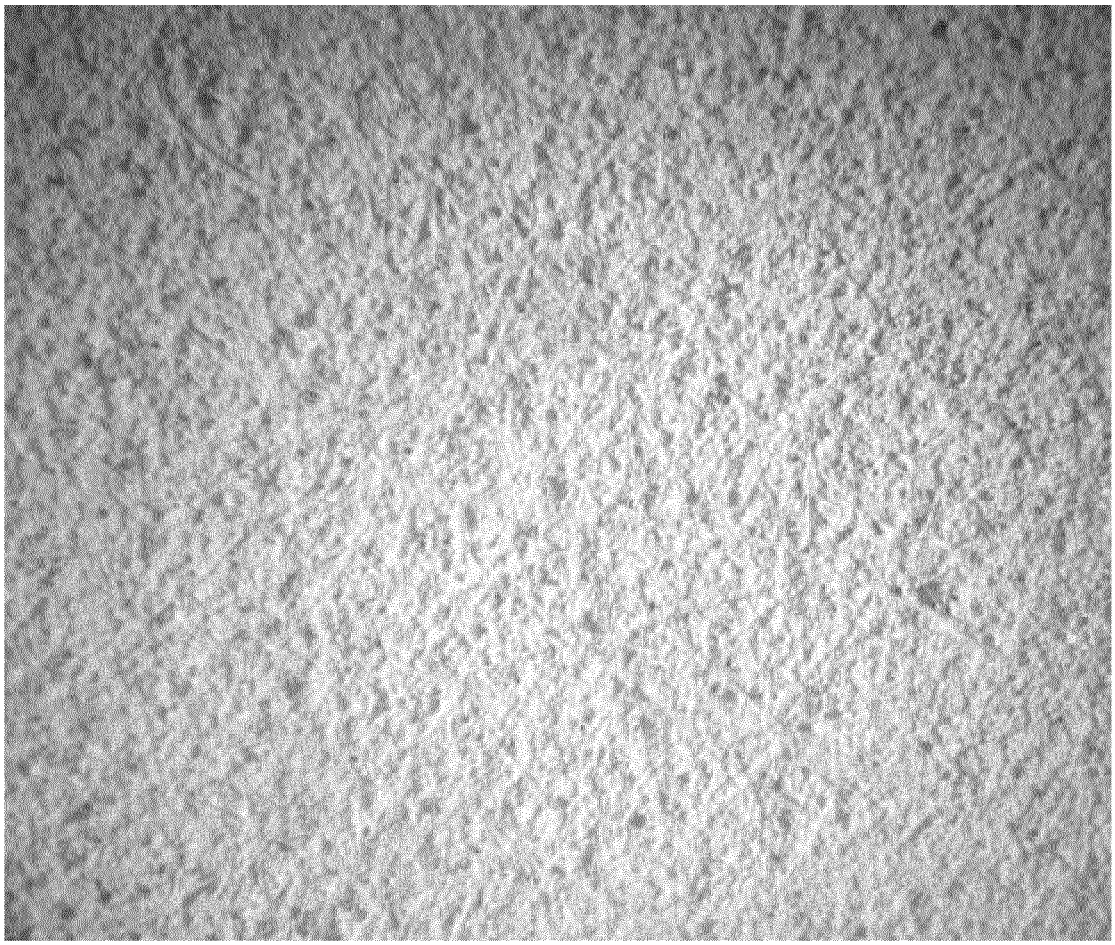
FIG. 3 is a photo of a coated surface.

FIG. 3 is a photo of the surface of the panel, and it can be seen that the coating covers the surface in a way to conceal any directional nature of the facing or subsurface. Further it can be seen that the surface is highly irregular and matt. Irregularity of the surface and the existence of small pin-holes in the surface coating safeguards the acoustic performance of the panel.

Figure 4:
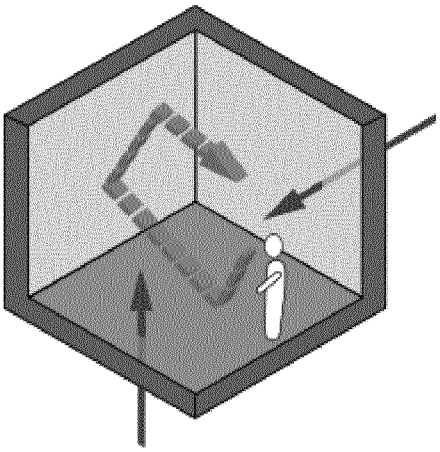
FIG. 4 is a sketch showing the principles in room acoustics.

In the sketch of FIG. 4 is illustrated how the acoustic performance of a room is influenced by external sound sources, and further by sound in the room reflected by the floor, walls and ceiling.

Figure 5:
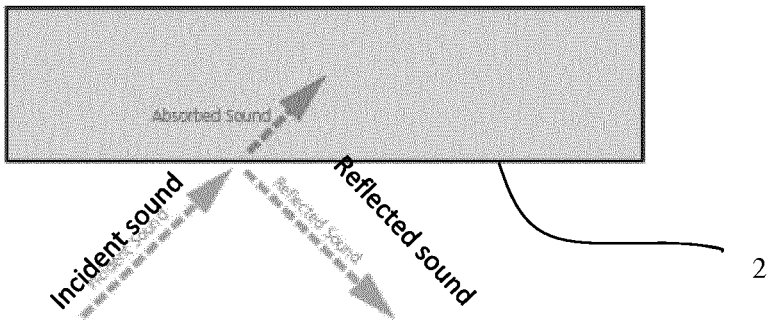
FIG. 5 is a sketch showing the principles in sound absorption of acoustic panels.
Figure 6:
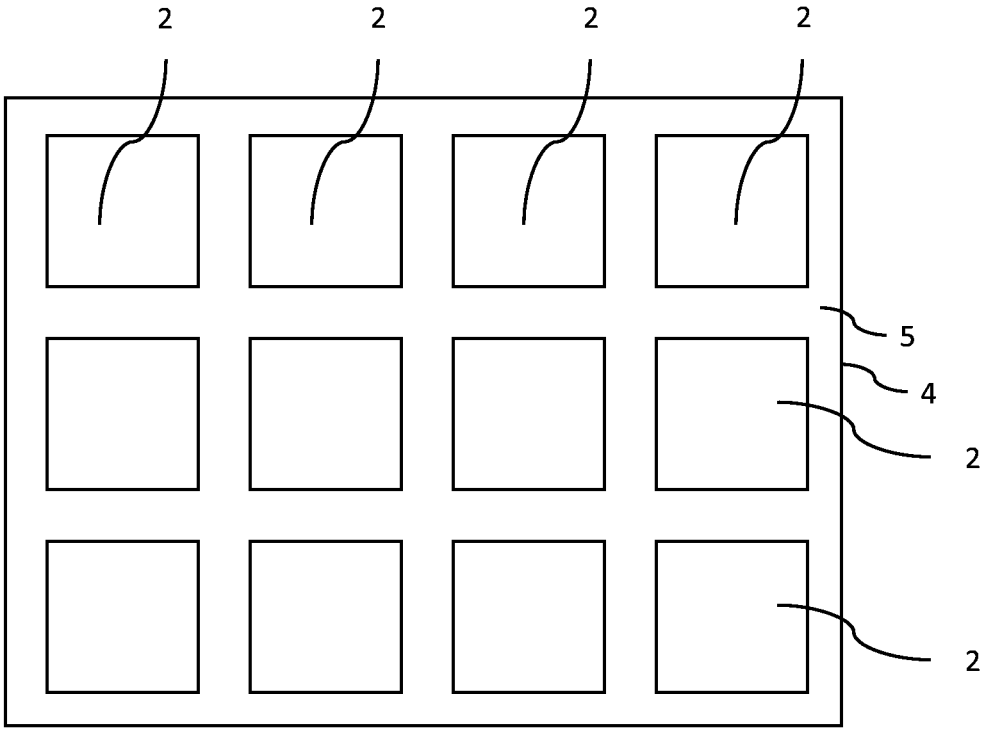
FIG. 6 is a sketch showing a ceiling system comprising an acoustic panel, as shown in FIG. 1, and a grid comprising a surface coating on surfaces visible in the installed state of the suspended ceiling.

FIG. 5 shows how incident sound may be absorbed in an acoustic panel if the incident sound is allowed to penetrate into the panel through the first major face (2), whereas some of the sound may be reflected back into the room.

Scrub Testing

A test to determine wet-scrub resistance of coated ceiling panels was carried out. Test samples were 430×110×6 mm panels of MMVF with a facing and coating including microspheres. The test was performed on an Erichsen scrub resistance tester in compliance with PN-EN ISO 11998:2007 requirements, however a soft PU sponge and not a brush, was used as a scrub body. The appearance of the coatings was assessed after 100, 200 and 500 cycles. Rating scale 1-5 was used to describe test results (1=Best, 5=Worst):

Class 1—minute changes visible,

Class 2—small thickness loss overall entire surface, no clearances to the surface, visible gloss loss, minute runs, Class 3—visible thickness loss and clearances to the surface, significant gloss changes and runs, Class 4—significant loss of a coating thickness and in some areas a panel surface becomes visible, Class 5—the panel surface damages (up to 100%).

As can be seen in the table below the sample showed excellent scrub resistance.

TABLE 4

| | Results after 100 scrub cycles | | Results after 200 scrub cycles | | Results after 500 scrub cycles | |
|---|---|---|---|---|---|---|
| Sample | Appearance | Quality class | Appearance | Quality class | Appearance | Quality Class |
| Acoustic panel | No changes | 1 | Shine, minute thickness loss | 2 | Shine, minute thickness loss | 2 |

Sound Absorption Test

A sample measuring 1200×600×20 mm was tested for sound absorption according to BS EN ISO 354:2003 with very favourable results. Sound absorption coefficient of $\alpha_w$=1.00 was reached (Class A), calculated to EN ISO 11654:1997 and NRC 0.95 calculated to ASTM C 423-01.

Light Reflection Testing

Measurement of light reflection of a sample of a panel provided with a coating with microspheres was performed. Spectral reflection was measured using a Perkin-Elmer Lambda 900 spectrophotometer equipped with an integrating sphere, geometry 8°/d. Reflection values, including and excluding specular components, was measured in steps of 5 nm from 380 up to and including 780 nm. From the results the X, Y, Z, x, y and L*, a* and b* coordinates were derived for a light source D65 and an observer of 10° (ISO 7724).

Additionally diffusivity measurements were executed with calibration in "including specular component" modus, while the actual measurement were executed in the "excluding specular components" modus. By doing so the amount of diffuse reflected light compared to the total amount of reflected light is measured.

Gloss was measured using a BYK-trigloss multiangle gloss measuring device. This device projects a light beam onto the sample's surface and measures the intensity of the specular reflected light. The angle can be chosen 20°, 60° or 85°. The intensity of the reflected light beam is expressed in gloss units.

TABLE 1

| Sample, acoustic panel | L* |
|---|---|
| Reflection, including specular gloss, average | 94.91 |
| Reflection, excluding specular gloss, average | 94.57 |

TABLE 2

| Sample, acoustic panel | L*/L* incl gloss (%) |
|---|---|
| Diffuse reflection, average | 99.78 |

TABLE 3

| Sample, acoustic panel Measuring angle | Gloss (gloss units) Average |
|---|---|
| 20° | 1.2 |
| 60° | 1.7 |
| 85° | 0.2 |

Diffusivity is very high, and the very high diffusivity is confirmed by the results of the gloss measurements, which show extremely low values.

With the high light reflection and low gloss the panels provide more light in a room equipped with the panels, and thereby the cost of lighting may be reduced, and further the living conditions are improved with a positive influence on the mood and productivity of people in the room.

The invention claimed is:

1. Acoustic panel, especially a man-made vitreous fibre (MMVF) panel, having a first major face and an opposite second major face, with the first major face comprising a facing with a surface coating, wherein the surface coating comprises microspheres, wherein the average diameter of the microspheres is in the interval of 10-200 μm;

wherein the facing is a non-woven or a felt having an air permeability of 400-900 $l/m^2/s$;

wherein the surface coating includes pinholes.

2. Acoustic panel according to claim 1, wherein the microspheres are made of silica, ceramic or glass.

3. Acoustic panel according to claim 1, wherein the average diameter of the microspheres is in the interval of 10-120 μm.

4. Acoustic panel according to claim 1, wherein the panel is a MMVF panel having a density in the range of 40-150 $kg/m^3$.

5. Acoustic panel according to claim 1, wherein the facing is based on glass fibres.

6. Suspended ceiling system comprising an acoustic panel according to claim 1 and a grid comprising a surface coating on surfaces visible in the installed state of the suspended ceiling, wherein the surface coating comprises microspheres.

7. Method for producing an acoustic panel comprising the steps of: providing an acoustic panel, especially a MMVF panel, attaching a front facing to a first major face of the panel, applying a surface coating on the front facing, wherein the surface coating comprises microspheres and pinholes, wherein the facing is a non-woven or felt having an air permeability of 400-900 $l/m^2/s$ and wherein prior to applying the surface coating, the surface coating is conditioned to have a viscosity of 20-40 s DIN CUP4.

8. Method according to claim 7, wherein the surface coating is applied using a low viscosity coating technique.

9. Suspended ceiling system according to claim 6 wherein the average diameter of the microspheres of the surface coating of the grid is in the interval of 10-200 μm.

10. Acoustic panel according to claim 1, wherein the microspheres include a pigment.

11. Acoustic panel according to claim 1, having an NRC value of at least 0.95.

12. Acoustic panel according to claim 1, wherein the facing is white with an L-value of at least 95.

13. A highly-reflective, low gloss acoustic panel comprising:

a man-made vitreous fibre (MMVF) panel having a first major surface and a second major surface;

a facing attached to the first major surface, the facing comprising a non-woven or a felt having an air permeability of 400-900 $l/m^2/s$; and a coating applied to the facing, the coating including microspheres having an average diameter of 10-200 μm and pinholes, which collectively provide the panel with high light diffusivity and low gloss.

* * * * *